US007328741B2

(12) United States Patent
Allen et al.

(10) Patent No.: US 7,328,741 B2
(45) Date of Patent: Feb. 12, 2008

(54) SYSTEM FOR SENSING RISER MOTION

(75) Inventors: John Allen, Houston, TX (US); Antonio J. Pinto, Richmond, TX (US)

(73) Assignee: Vetco Gray Inc., Houston, TX (US)

( * ) Notice: Subject to any disclaimer, the term of this patent is extended or adjusted under 35 U.S.C. 154(b) by 252 days.

(21) Appl. No.: 10/951,563

(22) Filed: Sep. 28, 2004

(65) Prior Publication Data

US 2006/0065401 A1 Mar. 30, 2006

(51) Int. Cl.

| | |
|---|---|
| ***E21B 29/02*** | (2006.01) |
| ***E21B 43/00*** | (2006.01) |
| ***G01C 9/00*** | (2006.01) |
| ***G01C 17/00*** | (2006.01) |
| ***G01C 19/00*** | (2006.01) |
| ***G06F 15/00*** | (2006.01) |

(52) U.S. Cl. ..... 166/64; 166/335; 166/367; 166/350; 702/150; 702/152

(58) Field of Classification Search ..... 166/64, 166/335, 367, 350, 336, 250.01; 702/6, 150, 702/152

See application file for complete search history.

(56) References Cited

U.S. PATENT DOCUMENTS

| | | | | |
|---|---|---|---|---|
| 4,205,379 | A * | 5/1980 | Fox et al. | 701/116 |
| 4,301,760 | A * | 11/1981 | Cassone et al. | 114/144 B |
| 4,317,174 | A * | 2/1982 | Dean | 701/116 |
| 5,978,739 | A * | 11/1999 | Stockton | 702/6 |
| 6,282,452 | B1 * | 8/2001 | DeGuzman et al. | 700/32 |
| 7,080,689 | B2 * | 7/2006 | Guesnon et al. | 166/355 |
| 2003/0205383 | A1 * | 11/2003 | Jordon | 166/355 |
| 2003/0230409 | A1 | 12/2003 | Guesnon et al. | |
| 2005/0100414 | A1 * | 5/2005 | Salama | 405/224.2 |

OTHER PUBLICATIONS

Chedzoy, Claire, et al., article titled "Design Challenges of Deepwater Dry Tree Riser Systems for Different Vessel Types," dated 2003.

* cited by examiner

*Primary Examiner*—F. Zeender
*Assistant Examiner*—Christopher Buchanan
(74) *Attorney, Agent, or Firm*—Bracewell & Giuliani LLP

(57) ABSTRACT

A riser monitoring assembly is provided to monitor and manage a riser extending between subsea well equipment and a floating vessel. A riser measurement instrument module is connected adjacent a selected portion of the riser provides dynamic orientation data for the selected portion of the riser. A computer having a memory associated therewith and riser system analyzing management software stored thereon is in communication with the riser measurement module to process data received therefrom. The riser monitoring assembly can utilize real-time orientation data for the selected portion of the riser to analyze the riser dynamic behavior, to determine a model of the real-time structure of the riser, to determine and manage the existence of vortex induced vibration, to determine and manage riser stress levels, to manage riser inspection and riser maintenance, and to supplement determination and management of the position of the vessel.

24 Claims, 6 Drawing Sheets

Vessel Measurement Instrument Module (Gyro):
Pitch (roll about y axis)
Roll (roll about x axis)
Yaw (Heading)

Wellhead (BOP) Measurement Instrument Module:
Inclination from Vertical

Subsea Measurement Instrument Module:

| | |
|---|---|
| Angular Displacement | |
| Pitch (roll about y axis) | 0.00 |
| Roll (roll about x axis) | 0.00 |
| Yaw (Heading) | 183.82 |
| Linear Displacement | |
| Surge (delta x) | 0.00 |
| Sway (delta y) | 0.00 |
| Heave (delta z) | 0.00 |
| Angular velocity | |
| Angle Rate x | 0.00 |
| Angle Rate y | 0.00 |
| Angle Rate z | 0.00 |
| Linear Velocity | |
| Lateral Speed x | 0.00 |
| Lateral Speed y | 0.00 |
| *Vertical* speed z | 0.00 |
| Angular Acceleration | |
| Angle ACC x | 0.00 |
| Angle ACC y | 0.00 |
| Angle ACC z | 0.00 |
| Linear Acceleration | |
| ACC x | 0.00 |
| ACC y | 0.00 |
| ACC z | 0.00 |

Surface Measurement Instrument Module:

| | |
|---|---|
| Angular Displacement | |
| Pitch (roll about y axis) | 0.00 |
| Roll (roll about x axis) | 0.00 |
| Yaw (Heading) | 183.20 |
| Linear Displacement | |
| Surge (delta x) | 0.00 |
| Sway (delta y) | 0.00 |
| Heave (delta z) | 0.00 |
| Angular velocity | |
| Angle Rate x | 0.00 |
| Angle Rate y | 0.00 |
| Angle Rate z | 0.00 |
| Linear Velocity | |
| Lateral Speed x | 0.00 |
| Lateral Speed y | 0.00 |
| *Vertical* speed z | 0.00 |
| Angular Acceleration | |
| Angle ACC x | 0.00 |
| Angle ACC y | 0.00 |
| Angle ACC z | 0.00 |
| Linear Acceleration | |
| ACC x | 0.00 |
| ACC y | 0.00 |
| ACC z | 0.00 |

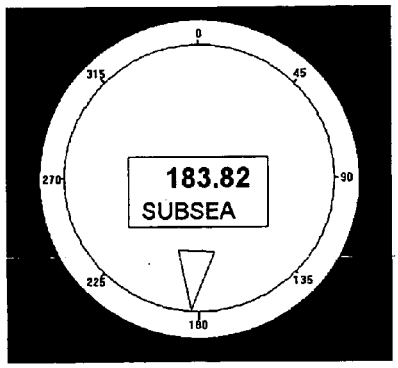

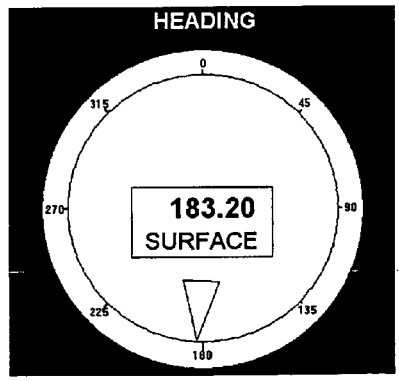

FIG. 3

SYSTEM FOR SENSING RISER MOTION

BACKGROUND OF THE INVENTION

1. Field of the Invention

This invention relates to riser management systems. More particularly, this invention relates to a system, an apparatus, and related methods for sensing riser dynamics.

2. Brief Description of the Related Art

A problem presented by offshore hydrocarbon drilling and producing operations conducted from a floating platform or vessel is the need to establish a sealed fluid pathway between each borehole or well at the ocean floor and the work deck of the vessel at the ocean surface. This sealed fluid pathway is typically provided by a drilling riser system. Drilling risers, which are utilized for offshore drilling, extend from the drilling rig to a blowout preventer (BOP) and Lower Marine Riser Package (LMRP), which connect to a subsea wellhead. Production risers extend from a surface vessel to a subsea wellhead system.

The drilling riser, for example, is typically installed directly from a drilling derrick on the platform of the vessel by connecting a series of riser joints connected together. After connecting the riser to the subsea wellhead on the seabed, the riser is tensioned by buoyancy cans or deck mounted tensioner systems. The riser is projected up through an opening referred to as a moon pool in the vessel to working equipment and connections proximate an operational floor on the vessel. In drilling operations, the drill string extends through a drilling riser, the drilling riser serving to protect the drill string and to provide a return pathway outside the drill string for drilling fluids. In producing operations, a production riser is used to provide a pathway for the transmission of oil and gas to the work deck.

Basic components of a riser system typically also include a tensioning system designed to provide lateral load resistance while providing a somewhat constant vertical tension. The tension is normally applied to a tensioning ring attached to the top of the riser and below a telescopic joint. A diverter seals around the drill pipe and diverts gas and drilling returns away from the drill floor. A slip or telescopic joint is designed to decouple the vessel and riser from vertical motions and maintain an integral seal for the riser pipe. A ball or flex joint provides a pinned connection to reduce the transmission of bending moments in the riser caused by a misalignment between the joints. Riser connectors are made up of sections typically bolted together with flanges or threadedly connected, each section being typically from 60-90 feet in length. Each section typically has a central riser pipe that is normally about 18-24 inches in diameter. Buoyancy devices are typically provided to reduce tensioning requirements, mainly in deep water conditions where the top tension required is greater than the available tensioning capacity. Various subsea equipment is located on the seafloor. The subsea equipment associated with a drilling riser might include a flex/ball joint, the BOP/LMRP, the wellhead, and a wellhead conductor. The BOP/LMRP typically includes valves and sensors controlled by a BOP/LMRP controller which is connected to the surface via an umbilical cord which includes a data conductor. The umbilical cord can be positioned between the BOP/LMRP controller or other subsea equipment and a computer or controller remotely positioned on a deployment platform of the vessel. An umbilical spool can, in turn, be positioned on the deployment platform for readily storing and deploying the umbilical cord.

Other more specialized riser equipment includes a fill-up valve designed to prevent collapse of the riser pipe due to the differential pressure between the inside of the riser pipe and the surrounding water, an instrument riser joint typically used to monitor the tension and bending due to environmental conditions which allows for adjustment in top tension and vessel positioning, vortex suppression equipment which help suppress vortex induced vibrations typically found in conditions of high current and long riser length, and an emergency riser release which provides a specialized riser release system to prevent catastrophic failure typically found in conditions where incorrect vessel positioning or extreme environmental conditions may occur.

The riser has design requirements that include operation and/or survival in extreme conditions in both connected and disconnected modes. Deepwater applications, especially, require close attention to the vertical dynamics of the riser. This generally requires an active riser management program. One goal of riser management is to determine the tension/buoyancy requirements and the operating limits based on a combination of the environmental parameters, the vessel capability, the drilling program (for drilling risers), and the operational constraints. Another goal or series of goals for both drilling and production risers is to manage stresses and loading of individual riser sections to provide for fatigue analysis and thus allow the operator to formulate an enhanced inspection, maintenance, and riser section rotation program. The environmental parameters include, among other things, wave height and period, water depth, current, wind, and tides. The vessel capability includes tensioning capacity, physical interface geometry, and vessel motion characteristics in terms of Response Amplitude Operator (RAO). The drilling program includes riser joint configuration, mud weights, and placement of components. The operational constraints to be considered are drilling modes, upper and lower displacements and forces, combined stresses, and tensioner losses.

The normal modes encountered in offshore drilling operations, for example, include normal or drilling mode, suspended or connected and nondrilling, and hangoff or disconnected mode. The drilling mode is that combination of environmental and well conditions in which normal drilling activities can be safely conducted. The connected and nondrilling mode is the mode when only circulating and tripping out drill pipe is conducted. The disconnect mode is when environmental conditions exceed the limits for safe operation in the connected and nondrilling mode and require the riser to be disconnected to prevent possible damage to surface or subsea equipment.

The loading on both drilling and production risers include internal and external hydrostatic pressures generated by the drilling mud and sea water, weights or buoyant forces generated by auxiliary components, and wave and current actions. The hydrodynamic forces generated by the waves can be based on a regular wave or a wave spectrum. The hydrodynamic forces generated by the current are calculated based on Morrison's Equation using the shape, roughness, Reynold's number, Keulegan-Carpenter Number, and orientation of auxiliary equipment. Standard values of drag and inertial coefficients have been developed. Loading on the riser system can additionally be generated by vortex shedding generated by the current, resulting in vortex induced vibration (VIV). VIV can be generated either in-line or cross-flow, and can induce high stresses if the shedding frequency matches the natural frequency of the riser.

Mathematical methods for the solution of the complex loading and motion in the riser are based on static, frequency domain, and time domain solution techniques. The static solution does not take into account any dynamics and is not as accurate for the overall analysis of the riser system, but can provide current and steady state loading information. The frequency domain solution uses linearization techniques to simulate the dynamic portion of the loading and can accurately model the loading, if the dynamics are moderate as compared to the static loading. The time domain can accurately model the dynamic loading and provide the most accurate modeling of both the linear and nonlinear conditions. The time domain solution can encompass a direct integration of the nonlinearities in the calculations, and requires a large number of solution iterations. The advent of more powerful computers has resulted in reasonable solution times and has made the time domain solution the most desirable method of solution.

The operational limits are based on providing a combination of tension, vessel location, and operating mode to maintain ball/flex joint angles, material physical property requirements, system component requirements, and prevent system component failure. Obtaining data to provide to the computer systems, however, has proved more problematic. Especially regarding drilling operations, system integration has been difficult due to the insular nature of the different control systems on the drilling rig. The operator interfaces currently in use have inherent accuracy limitations due to low update rates and do not capitalize on the importance of lower flex joint angle ("LFJA")/upper flex joint angle ("UFJA") differential, nor the importance of modeling the dynamic shape of the riser.

Current systems of monitoring ball/flex joint angle values do not provide riser managers sufficient data to properly maintain such operational parameters. Some recent systems include instrument modules that can provide static differential angle of the riser. The systems were, however, originally designed to support drilling operations, not riser management systems, and are not suitable as a basis for riser analysis because they provide only a limited set of measurements, and typically only for the lower flex joint. Current systems generally provide only static accuracy. That is, current systems generally only provide a static lower flex joint angle of inclination, values of which are affected by lateral acceleration, and which does not allow for real-time management of the riser system. Further, the inclination is referenced to a coordinate system separately assigned to the individual instrument housing or case, itself, rather than a globally assigned coordinate system. Thus, such systems are difficult to integrate with other more globally based systems.

In an attempt to acquire data on the behavior of a riser under determined conditions, a more recent French system is being developed which utilizes a series of instrument modules consisting of lateral accelerometers and inclinometers connected along the length of the riser string and to the lower marine riser package to determine the two-dimensional deflected shape of the riser. The modules are connected to a computer through a data transmission cable extending the length of the riser string. This system, however, does not provide dynamic angular position and orientation of the riser. The system also apparently only provides two-dimensional (planar) angular measurements. Further, this system has not been shown to be practical because each module is individually connected to the data transmission cable through individual cable leads along the length of the data transmission cable. Thus, the data transmission cable requires a series of terminators/taps along the length of the cable. If a section of the riser carrying one of the modules is removed, the module will need to be either moved to another section, or the module will need to be disconnected from the data transmission cable and cap added to replace the removed module. In either scenario, the procedure is rather labor-intensive and requires disruption of the drilling operation and/or the management of the riser.

SUMMARY OF THE INVENTION

In view of the foregoing, embodiments of the present invention provide a system, assembly, software, and related methods provide real-time, full-time data obtained through an online sensor package including a measurement instrument module having gyroscopes and accelerometers, deployable at a discrete location adjacent top and/or bottom locations of the riser, and that provide data which is dynamically accurate and which can be used in all riser modes of operation including installation, drilling, non-drilling, production, disconnect, and retrieval, to allow real-time management of the riser system. Embodiments of the present invention can include a high-speed subsea network backbone and that can utilize both a riser lower portion angle (RLPA) and a riser upper portion angle (RUPA) differential for modeling the dynamic shape of the riser, providing dynamic three-dimensional angular position and orientation of the riser, which can be referenced to a globally assigned coordinate system. Advantageously, the directional information can be provided in terms of True North, rather than merely being referenced to a local coordinate system assigned to the measurement instrument module unit itself. Advantageously, this configuration enhances seamless integration with other globally based systems.

Riser measurement instrument modules can communicate data to the surface via a high data-rate media such as fiber optics, electric cabling, or high data E/H or acoustics. Data transmitted includes angular acceleration, angular velocity, angular displacement, liner acceleration, linear velocity, linear displacement and heading. Heading can be computed by the digital signal processor based on acceleration measurements. The data can be received in real-time and can be displayed and stored cyclically for retrieval. This data can provide highly accurate riser joint angles and riser dynamic information at high data rates.

Embodiments of the present invention also can utilize the umbilical cord for a blowout preventer ("BOP"), a lower marine riser package ("LMRP"), or other subsea equipment to provide power and data transmission capability for the measurement instrument module or modules located adjacent the wellhead system. Further, vessel power and data transmission capability can be utilized for a measurement instrument module located adjacent to the vessel. This negates a need for providing a separate data or power transmission line or providing taps into the umbilical cord. Embodiments of the present invention include software that can determine an angular differential between a bottom location of the riser and the wellhead/wellhead conductor, and angular differential between a top location of the riser and a surface vessel carrying the riser, and an angular differential between the top and bottom locations of the riser. The software can also model the riser structure between the top and bottom locations of the riser.

More specifically, embodiments of the present invention provide an offshore drilling and/or production system having a deployed drilling riser or conductor extending between subsea well equipment and a floating vessel and riser monitoring assembly. The riser pipe or conductor has multiple riser sections connected together by joints and extends between a sea bottom and the floating vessel. When in the form of a drilling riser, the riser is connected at its distal end to a LMRP held by a vessel tensioning system at its proximal end. An upper and a lower portion of the riser, preferably in the form of a ball or flex joint having upper and lower joint angles, respectively, provide a pinned connection to reduce the transmission of bending moments in the riser caused by a misalignment between the riser joints. The LMRP is releasably yet rigidly connected to a blowout preventer ("BOP") atop a wellhead. The LMRP is electrically and/or optically connected to the surface via an umbilical cord which is located between a LMRP umbilical cord termination bottle or junction box and a surface junction box. The umbilical cord includes at least one power and at least one data conductor housed within to provide a power and a high-speed data connection. When in the form of a production riser, the LMRP and BOP are generally removed.

Riser dynamics can be determined from a measurement instrument module located near the surface, preferably adjacent the upper or proximal portion of the riser, and/or a measurement instrument module located subsea preferably adjacent the lower or distal portion of the riser. The measurement instrument modules are of such a configuration, generally in the form of a self-contained inertial navigation system, that additional intermediate measurement instrument modules are generally not required. Advantageously, the physical positioning of the subsea measurement instrument module, preferably connected adjacent an upper section of a lower flex joint (if the riser is so configured), allows such module to connect with the umbilical cord termination bottle (junction box) associated with the LMRP or other nearby subsea equipment to thereby communicate with the surface through the umbilical cord. Correspondingly, advantageously this riser measurement instrument module configuration allows the surface measurement instrument module, preferably connected adjacent a lower section of an upper flex joint (if the riser is so configured), to connect with the vessel network, directly, rather than through the umbilical cord. Thus, this riser measurement instrument module configuration advantageously negates the need for a separate data line or for taps along the length of the data line, which would need to be fitted with terminators if a section of riser having such an intermediate measurement instrument, were removed, replaced, or rotated.

The measurement instrument modules can provide real-time dynamic three-dimensional position and orientation data which can be used to determine a tilt and heading for a respective riser lower portion and riser upper portion. To prevent the necessity for a separate umbilical cord to house a high-speed communication line for the subsea riser management instrument module in a riser having a LMRP, the module can be electrically connected to a LMRP riser management system interface or junction box which can be both electrically and/or optically connected to the umbilical cord termination bottle. Note, in an alternate configuration, the module can be connected directly to the umbilical cord termination bottle.

In the preferred embodiment of the present invention, the dynamic orientation data provided by the riser measurement instrument module or modules is related to a global coordinate system preferably with the heading referenced to True North. The riser measurement instrument module or modules each preferably include a trio of linear accelerometers which provide linear acceleration data, a trio of preferably fiber-optic gyros which provide angular acceleration data, and a digital signal processor which processes the linear and angular acceleration data. The digital signal processor can determine the dynamic orientation data from the trio of linear accelerometers and the trio of fiber-optic gyros. The dynamic orientation data preferably includes angular acceleration, angular velocity, angular displacement, liner acceleration, linear velocity, linear displacement, and heading of the respective lower and upper section of the riser, preferably referenced to True North.

A wellhead measurement instrument module can provide wellhead angle of inclination from vertical used as a correction factor to determine the orientation of the lower portion of the riser and angle for a lower flex joint, if so configured. This correction is required because wellheads are not typically oriented exactly vertical. If the riser system includes a LMRP, the wellhead measurement instrument module is preferably connected to a rigid portion of the LMRP and preferably electrically connected either directly to the umbilical cord termination bottle or through LMRP riser management system interface. This allows the riser monitoring assembly to remain intact in the event the riser must be disconnected at the LMRP from the wellhead and while being carried by the vessel. Correspondingly, a vessel measurement instrument module, generally connected to a rigid portion of the vessel, provides vessel pitch and roll, defining a vessel angle of inclination, and can provide vessel heading referenced to True North. The vessel angle of inclination from vertical can be used as a correction factor to determine the orientation of the upper portion of the riser and the angle of an upper flex joint, if so configured. This correction factor is generally required because the vessel, due to waves and currents of the seawater, does not generally maintain a vertical orientation.

A computer carried by the vessel has a processor in communication with the riser measurement instrument module or modules, the wellhead measurement instrument module, and the vessel measurement instrument module to process data received from the modules. The computer has a memory associated therewith and riser management system analyzing software stored in the memory. The riser system analyzing software is provided to analyze riser dynamic behavior.

The riser management system analyzing software can utilize real-time measured environmental states and the real-time measured relative position and orientation of the lower, upper, or medial portions or sections of the riser. Riser position and orientation can be determined from the data provided by the measurement instrument modules and riser model structures organized in the table of models to allow a manager to analyze the riser dynamic behavior, and thus, determine a model of the real-time structure of the riser. Riser position and orientation can also be used to supplement determination and management of the position of the vessel with respect to the wellhead. The riser position and orientation along with or in addition to riser vibration data further can allow the manager to determine and manage the existence of vortex induced vibration, and determine stress levels in individual riser sections.

BRIEF DESCRIPTION OF THE DRAWINGS

So that the manner in which the features, advantages and objects of the invention, as well as others which will become apparent, are attained and can be understood in more detail, a more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

FIG. 3 is a schematic diagram of the graphical user display displaying processed data according to an embodiment of the present invention.

DETAILED DESCRIPTION

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

Figure 1:
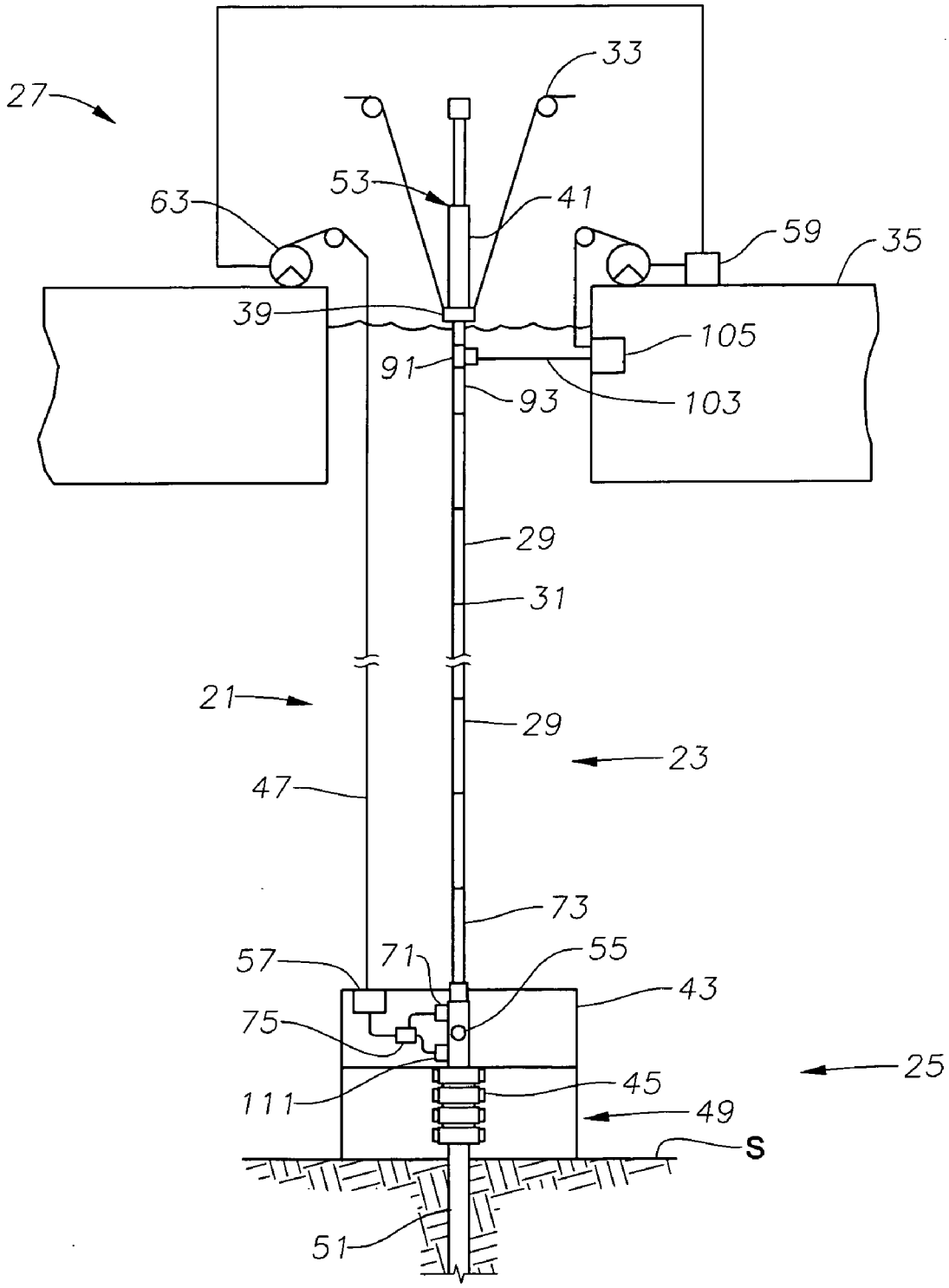
FIG. 1 is a perspective view of a system to monitor and manage a riser extending between subsea well equipment and a floating vessel according to an embodiment of the present invention.
Figure 2:
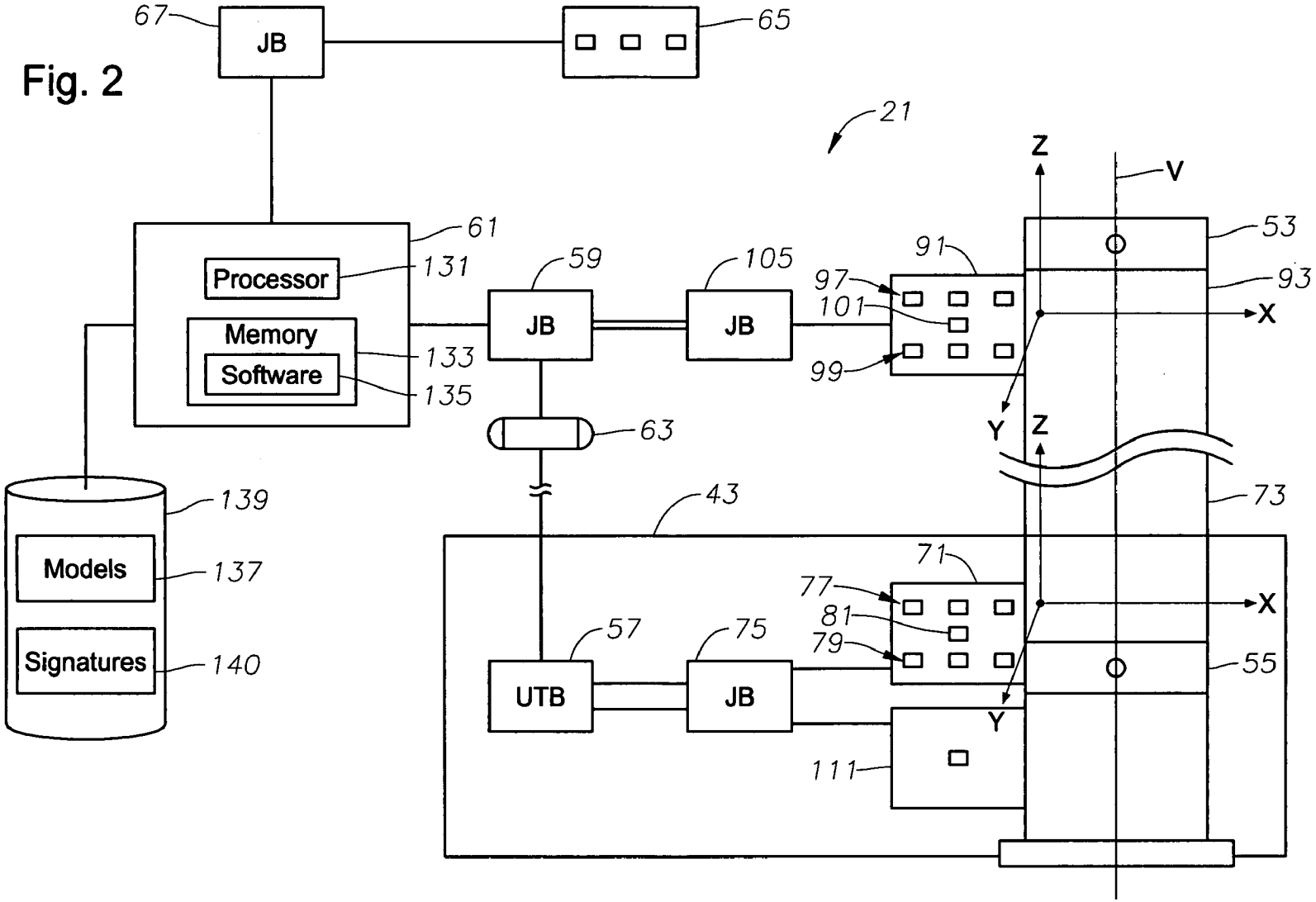
FIG. 2 is a schematic diagram of a riser monitoring assembly to monitor a riser extending between subsea well equipment and a floating vessel according to an embodiment of the present invention.
Figure 6:
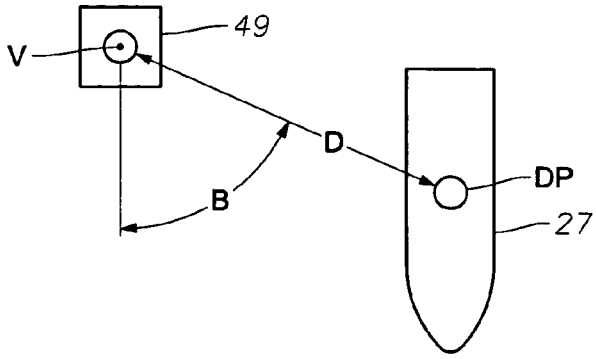
FIG. 6 is a schematic view of a method of determining a position of a dynamically positionable vessel according to an embodiment of the present invention.

Referring to FIGS. 1 and 2, embodiments of the present invention generally provide an offshore drilling and/or production system 21 including a riser monitoring assembly for monitoring and managing a drilling riser pipe 23 extending between subsea well equipment 25, such as, for example, the illustrated subsea wellhead, and a floating vessel, such as, for example, a dynamically positionable vessel 27 (see also FIG. 6). Embodiments of the present invention can provide data required by parties interested in riser response, allowing managers to manage the riser system 23 to minimize and manage stress and loading on the riser system 23, to determine riser component performance and analyze component fatigue useful for both operational and maintenance management programs, and to determine and manage vortex induced vibration. Additionally, embodiments of the present invention can provide the dynamically positionable vessel 27 information useful as a position back-up to the vessel's hydro-acoustic reference system.

More specifically, referring to FIG. 1, shown is a deployed drilling riser pipe or conductor 23 having multiple riser sections 29 connected together by joints 31 and extending between a sea bottom S and a floating vessel, such as, for example, the dynamically positionable vessel 27. A tensioning system 33 located on an operational platform 35 of the vessel 27 provides both lateral load resistance and vertical tension preferably applied to a slip or tensioning ring 39 attached to the top of the riser 23 and below a telescopic joint 41. The telescopic joint 41 decouples the vessel 27 and riser 23 from vertical motions. The deployed drilling riser 23 is further connected at its distal end to a lower marine riser package ("LMRP") 43. The LMRP 43 is releasably yet rigidly connected to a blowout preventer ("BOP") 45. The LMRP 43 and BOP 45 typically include valves and sensors controlled by a surface controller (not shown) and/or a BOP controller (not shown) which is connected to the surface via an umbilical cord 47 which generally includes at least one power and at least one data conductor housed within. A wellhead 49 located adjacent to the subsea floor S includes an upper section and a lower section. The BOP 45 is fixedly connected to the upper section of the wellhead 49. The lower section of the wellhead 49 connects to a wellhead conductor 51 which extends downwardly through the subsea floor S. A diverter (not shown) is located at the upper (proximal) end of riser 23 and has an elastomeric element that closes around a section of pipe of the drilling riser 23. A side outlet of the diverter delivers the drilling fluid to equipment for clearing the drilling fluid as it circulates. An upper and a lower ball or flex joint 53, 55, provides a pinned connection to reduce the transmission of bending moments in the riser 23 caused by a misalignment between the joints 31.

Referring also to FIG. 2, the umbilical cord 47 can be positioned between the BOP controller generally through use of an umbilical cord termination bottle or junction box 57 and a junction box 59 remotely positioned on the operational platform 35 of the vessel 27 that is electrically or optically connected to a computer or controller 61. An umbilical spool 63 can, in turn, be positioned on the operational platform 35 for readily storing and deploying the umbilical cord 47. The vessel 27 has a vessel measurement instrument module 65, generally known to those skilled in the art, which can provide vessel pitch and roll information to the computer 61 through a junction box 67. This pitch and roll information generally defines a vessel angle of inclination. The vessel measurement instrument module 65 also generally provides vessel heading referenced to a global coordinate system, e.g., true and/or magnetic north. Note, though embodiments of the present invention apply to both drilling and production risers, the drilling riser was selected for illustration and discussion due to the need for additional components such as, for example, the LMRP and BOP, not generally required in a production riser.

Referring to FIGS. 1 and 2, generally riser dynamics can be determined from a measurement instrument module or modules (described below) located adjacent the upper or proximal portion of the riser 23 and/or the lower or distal portion of the riser 23 without requiring intermediate measurement instrument modules except optionally a second module adjacent the upper portion sufficiently spaced apart from the first upper module if the first upper module is likely to be rendered useless by other associated surface equipment, or to provide for system redundancy. Such configuration allows the measurement instrument module or modules adjacent the lower portion of the riser 23 to connect with the umbilical cord termination bottle (junction box) 57 associated with the LMRP 43 to thereby communicate with the surface through the umbilical cord 47. Correspondingly, this configuration also allows the measurement instrument module or modules adjacent the vessel 27 to connect with the vessel 27, directly. This configuration also negates the need for a separate data line or for taps along the length of the data line which would need to be fitted with terminators if a section 29 of riser 23 having such an intermediate measurement instrument were removed.

The system 21 can include a subsea riser measurement instrument module 71, preferably in the form of a self-contained inertial navigation system connected to a lower portion of the riser 23, and preferably adjacent an upper section of the lower flex joint 55. Module 71 can provide real-time dynamic three-dimensional orientation data, including positional data, which can be used to determine a tilt and heading for a lower portion, preferably lower section 73, of the riser 23. To prevent the necessity for a separate umbilical cord, umbilical cord 47 can house a high-speed communication line for use by the subsea riser management instrument module 71. Module 71 can be electrically connected to a LMRP riser management system interface or junction box 75 which can be both electrically and/or optically connected to the umbilical cord termination bottle (junction box) 57. Note, in an alternate configuration, the module 71 can be connected directly to the umbilical cord termination bottle 57.

In the preferred embodiment of the present invention, the dynamic orientation data is related to a global coordinate system with the heading referenced to True North. The subsea riser management instrument module 71 preferably includes a trio of linear accelerometers 77 which provide linear acceleration data, a trio of preferably fiber-optic gyros 79 which provide angular acceleration data, and a digital signal processor 81 which processes the linear and angular acceleration data. The digital signal processor 81 determines the dynamic orientation data from the trio of linear accelerometers 77 and the trio of fiber-optic gyros 79 by a methodology known to those skilled in the art, i.e. integration with respect to time.

Still referring to FIGS. 1 and 2, the system 21 includes a surface (or near surface) riser measurement instrument module 91 also preferably in the form of a self-contained inertial navigation system. Module 91 is connected to an upper portion of the riser 23, preferably adjacent a lower section of the upper flex joint 53 underneath the tension ring 39. Module 91 can provide real-time dynamic three-dimensional orientation data, including positional data, which can be used to determine a tilt and heading for an upper portion of the riser 23, preferably upper section 93. Module 91 also can include a trio of linear accelerometers 97, a trio of fiber-optic gyros 99, and a digital signal processor 101 which determines or calculates dynamic orientation data. Module 91 can provide angular acceleration, angular velocity, angular displacement, liner acceleration, linear velocity, linear displacement, and heading of the upper section 93 of the riser 23.

Due to the positioning of module 91, module 91 can be electrically connected through a data line or conductor 103 to a vessel riser management system interface or junction box 105, typically located on or adjacent the deployment platform 35 of the vessel 27. Also, due to the use of a high-speed data line within umbilical cord 47, the differential between the times of arrival of the data supplied by the modules 71, 91, can be considered negligible. Further, because the data, including heading, produced by the modules 71, 91, can be referenced to a global coordinate system, the data can be easily correlated and integrated with other vessel and related measurement systems.

Note, alternate configurations, such as those using acoustics rather that fiber optics or wire, are within the scope of the present invention, however, the time delay between the modules 71, 91, would need to be compensated for. Note also, in the illustrated embodiments, the subsea riser measurement instrument module 71 is connected to the lowest section 73 of the riser 23 adjacent the lower flex joint 55 and the surface riser measurement instrument module 91 is connected to the highest section 93 of the riser 23 just below the tension ring 39. The positioning of the modules 71, 91, however, need not necessarily be as illustrated. Either of the modules 71, 91, could be connected to other adjacent sections 29 further toward a medial portion of the riser 23, however, this is not preferred due to a perceived degradation in accuracy and the need for longer data connection lines between the modules 71, 91, and their associated interface or junction box 75, 105. Further, for a production riser not having a LMRP 43, although, as with the drilling riser, only one riser measurement instrument module 71, 91, is generally required, if the riser measurement instrument module 71 is utilized, the umbilical cord termination bottle 57 can be associated with an alternative piece of nearby or adjacent subsea equipment (not shown) to provide a connection between the umbilical cord 47 and the module 71.

Referring also to FIG. 3, the dynamic orientation data preferably includes angular acceleration, angular velocity, angular displacement, liner acceleration, linear velocity, linear displacement, and heading of the lower section of the riser, preferably referenced to True North. Depending upon the assigned coordinate system, the angular displacement provides pitch (roll about the y axis), roll (roll about the x axis), and yaw (heading). The linear displacement provides surge ($\Delta$ x), sway ($\Delta$ y), and heave ($\Delta$ z). The angular velocity provides rotation rate along the x, y, and z axes. The linear velocity provides linear speed along the x, y, and z axes. The angular acceleration provides rotational acceleration along the x, y, and z axes. The linear acceleration provides straight-line acceleration along the x, y, and z axes. Because, in the preferred embodiment of the present invention, the measurement instrument modules 71, 91, are in the form of a self-contained inertial navigation systems, illustratively one could consider the associated riser section 29 of the riser 23 as being a tubular vessel having a globally oriented navigation system, and which is connected to the remaining sections 29 of the riser 23. Thus, submarine and surface vessel modeling can be useful in analyzing the orientation data, preferably including position data provided by the measurement instrument modules 71, 91.

A wellhead measurement instrument module 111 is connected to a rigid portion of the LMRP 43 and preferably electrically connected either directly to the umbilical cord termination bottle 57 or through LMRP riser management system interface 75. The wellhead measurement instrument module 111 provides wellhead angle of inclination a from vertical V (FIG. 5) used as a correction factor to determine the orientation of the lower section 73 of the riser 23 generally required because wellheads 49 are not typically exactly vertical. Utilizing this data, a difference between the wellhead angle of inclination a and a three-dimensional angle of inclination of the lower portion or lower riser section 73, determined from the dynamic orientation data for the lower riser section 73, can be readily determined. Such difference defines a riser lower portion angle ("RLPA"), and if configured according to the preferred embodiment, further defines a lower flex joint angle ("LFJA"). Although the wellhead measurement instrument module 111 can be in the form of an instrument module similar to the surface or subsea riser measurement instrument modules 71, 91, it need not be because the wellhead 49 can be considered stationary and immobile, and thus, not subject to the various accelerations described above.

Referring to FIG. 2 the vessel measurement instrument module 65, generally connected to a rigid portion of the vessel 27 (FIG. 1), provides vessel pitch and roll, defining a vessel angle of inclination, and a vessel heading typically referenced to True North. The vessel angle of inclination from vertical (vertical axis V) is used as a correction factor to determine the orientation of the upper portion or upper section 93 of the riser 23, generally required because the vessel 27, due to waves W and currents C (FIG. 5) of the seawater, does not generally maintain a vertical orientation. Utilizing this data, a difference between the vessel angle of inclination and a dynamic three-dimensional angle of inclination of the upper portion or upper riser section 93, determined from the dynamic orientation data for the upper portion or upper riser section 93, can be readily determined. Such difference defines a riser upper portion angle ("RIJPA"), and if configured according to the preferred embodiment, further defines an upper flex joint angle ("UFJA"). flex joint angle ("UFJA").

Computer 61 (FIG. 2) can be carried by the vessel 27. Computer 61 has a processor 131 in communication with the subsea and surface riser measurement instrument modules 71, 91, the wellhead measurement instrument module 111, and the vessel measurement instrument module 65 to process data received from the modules. Computer 61 has a memory 133 including riser management system analyzing software 135. A table/database of known riser models 137 corresponding to different riser states is stored in database 139 forming part of the memory 133 but preferably physically located in a separate storage device accessible through a direct connection (as illustrated) or through a network (not shown). A database of riser vibration signatures 140, generally obtained from test and experimental data, can also be stored in database 139. The riser management system analyzing software 135 (see also FIG. 4) can utilize real-time measured environmental states and the real-time measured relative position and orientation of the lower and upper sections 73, 93, or an intermediate section or sections therebetween, of the riser 23 determined from the data provided by the instrument modules 65, 71, 91, 111, and the model structures in the table of models 137, to analyze riser dynamic behavior. Thus, software 135 can determine a model of the real-time structure of the riser, which can typically take the form of an expanding spiral. The software 135 can further determine and manage the existence of vortex induced vibration (FIG. 5) and can supplement determination and management of the position of the vessel 27 with respect to the wellhead 49 (FIG. 6). Note, the software 135 can be in the form of microcode, programs, routines, and symbolic languages that provide a specific set for sets of ordered operations that control the functioning of the hardware and direct its operation, as known and understood by those skilled in the art.

Figure 4:
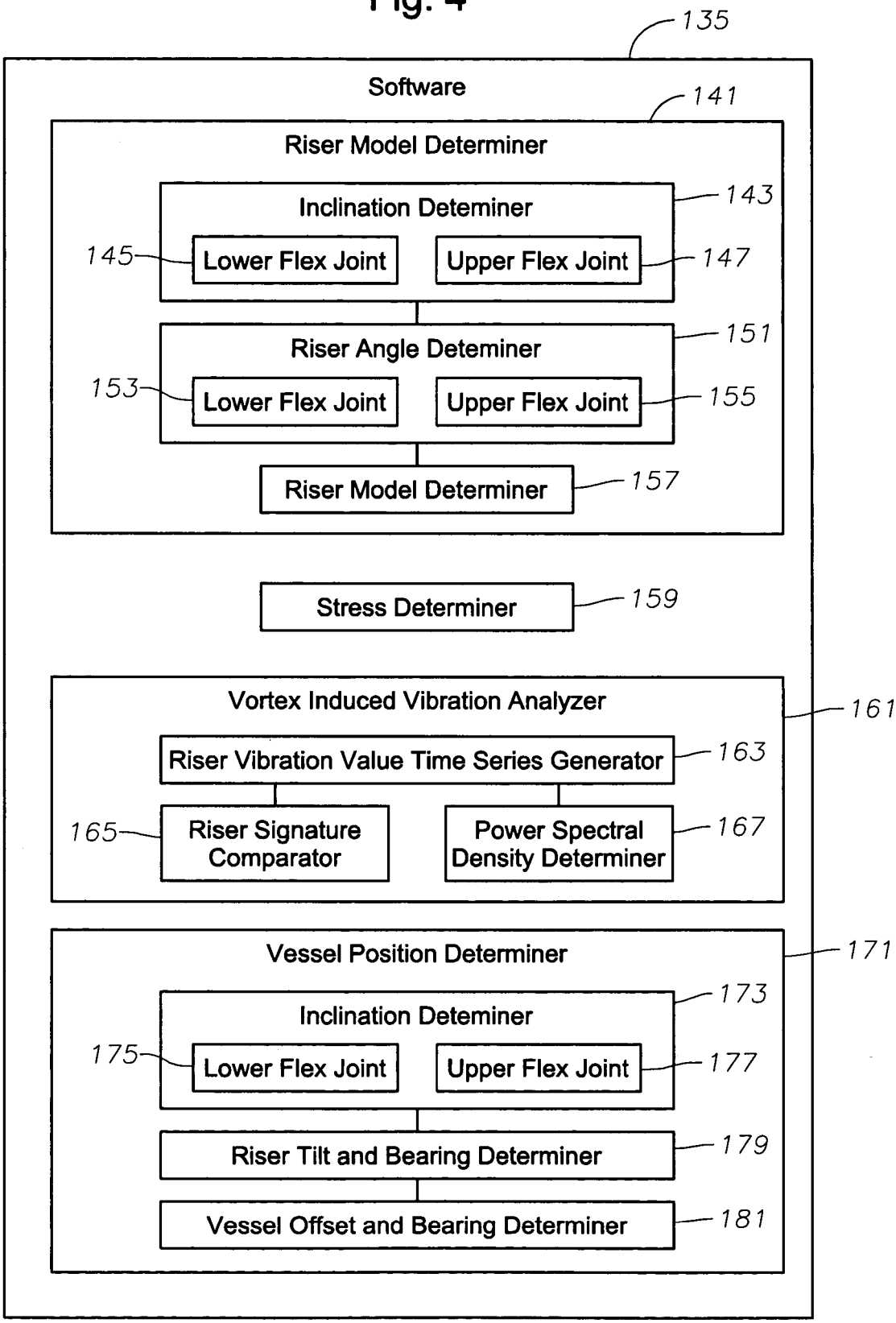
FIG. 4 is a diagram of software for analyzing riser dynamic behavior of a riser system extending between a floating vessel and a subsea wellhead according to an embodiment of the present invention.

Referring to FIG. 4, the riser management system analyzing software 135 can be separately stored on a storage media, such as a computer hard drive, a compact disc, or other media, known to those skilled in the art, for upload into a computer memory such as a random access portion of memory 133. The software 135 can record and display data used to determine the dynamic angle of the lower and upper sections 73, 93, or an intermediate section or sections therebetween, of the riser 23, and can use this information in conjunction with a predetermined riser model accessible from table/database of models 137 to display riser topography and to display information related to riser performance. The result of the riser analysis provides enhanced monitoring and management of the riser 23.

For example, in an embodiment of the present invention, the software 135 includes a riser model determiner 141 which, responsive to the data provided by either or both of the subsea riser measurement instrument module 71 and the surface riser measurement instrument module 91, can determine a model of the riser representing a real-time shape of the riser 23. The riser model determiner 141 can include an inclination determiner 143 which, responsive to orientation data from the subsea and surface subsea riser measurement instrument modules 71, 91, can determine dynamic three-dimensional inclination data for riser lower and the upper portions, such as the lower and upper riser sections 73, 93. Note, the inclination determiner 143 can be a single software module or be divided into functionally separate modules 145, 147. The software 135 also includes a riser angle determiner 151 which can also be a single software module or be divided into functionally separate modules, i.e., a riser lower angle determiner 153 and a riser upper angle determiner 155. The riser lower angle determiner 153, responsive to the dynamic three-dimensional inclination data for the lower riser portion or lower riser section 71 and inclination data from the wellhead measurement instrument module 111, determines the RLPA for the riser 23 and the LFJA, if configured according to the preferred embodiment. Correspondingly, the riser upper angle determiner 155, responsive to the dynamic three-dimensional inclination data for the upper riser portion or upper riser section 91 and preferably also inclination data from the vessel measurement instrument module 65, determines the RUJA for the riser 23, the UFJA if configured according to the preferred embodiment.

In the preferred embodiment of the present invention, a riser model determiner 157, responsive to the determined RLJA and the RUJA and the table/database of models 137 stored in the memory 133, determines the real-time riser dynamic structure by fitting the determined RLJA and RUJA to a model from the table/database of models 137. This allows for selection of a model best coinciding with the determined riser lower and upper portion angles. In another embodiment of the present invention, the riser model determiner 141 can also receive processed input from various other riser monitoring components such as strain gauges, current and wave velocity and direction meters, and vessel position indicators, to improve model selection.

Whether for a drilling riser, described in detail above, or a production riser, utilizing the determined riser model along with additional riser statistics such as displacement, bending moment, radius of curvature, and/or others known to those skilled in the art, an operator can determine the stress (including change in stress) and loading of sections 29 of the riser 23, which can ultimately lead to a determination of fatigue. The software 135 can include a stress determiner 159 to accomplish this task. With this information, the operator can also adjust inspection schedules, operation schedules, and maintenance schedules. This further allows the operator to improve asset management by adjusting rotation schedules of the sections 29 whereby sections of riser 23 subjected to above-average stress can be rotated with or replaced by sections 29 subjected to below-average stress.

Figure 5:
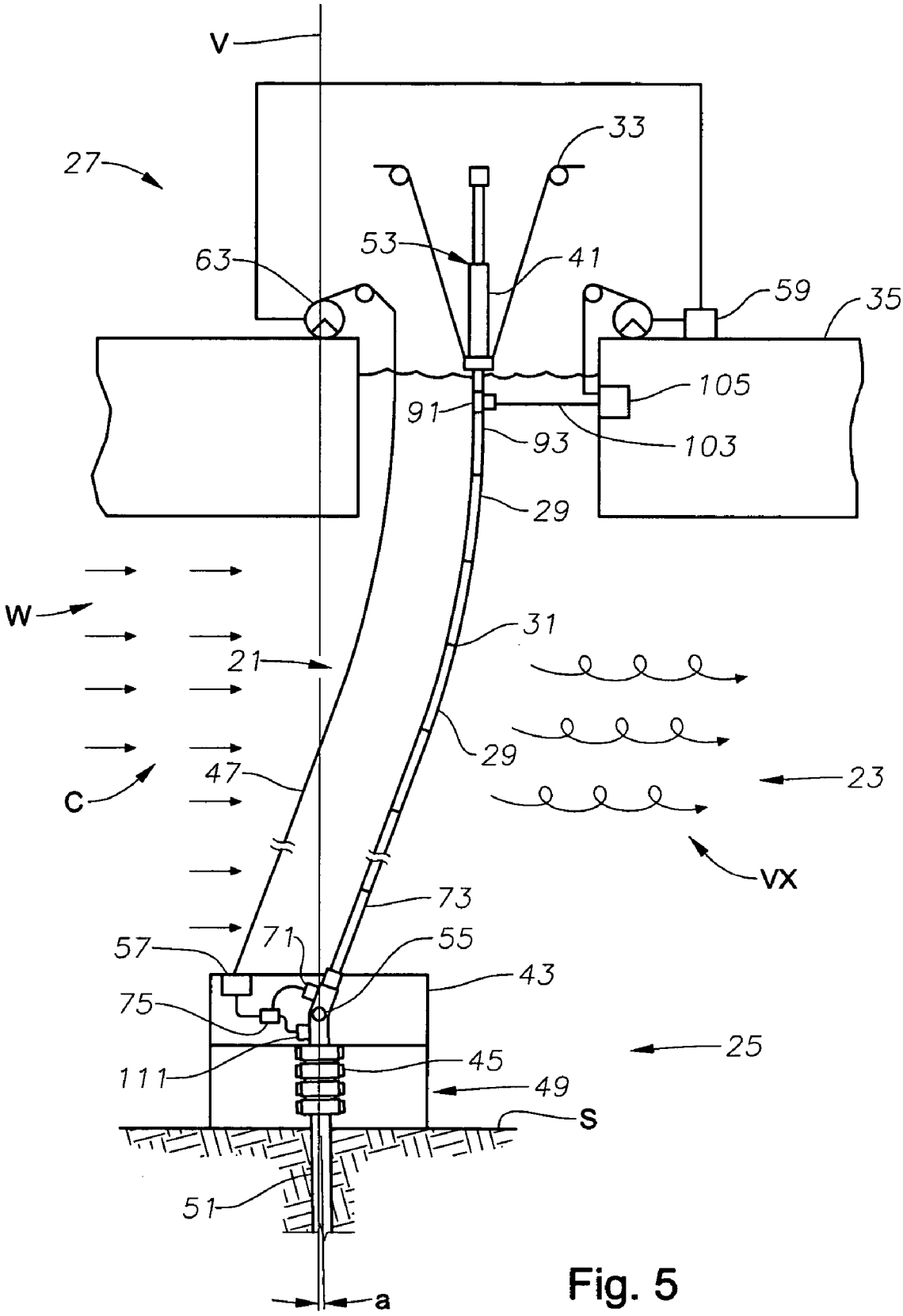
FIG. 5 is an environmental view of a portion of the system shown in FIG. 1 according to an embodiment of the present invention.

Referring to FIGS. 4 and 5, the software 135 can record and display vibration information including both high-frequency and low-frequency translations. Using this vibration information, the software 135 can predict riser endurance for maintenance planning and can analyze the vibration information to detect, real-time, the onset of excessive vortex induced vibration resulting from shedding vortices VX caused by waves W and currents C, allowing for real-time management of the riser 23. This vibration information can be compared to a database of the riser vibration patterns or signatures 140 which can be length and mode dependent. The comparison can be used to determine a vibration model which can be used in determining stress (including change in stress) and thus, fatigue, for various sections 29 of the riser 23. This information can be used in the decision process relating to operation of the drilling riser 23, and in particular, in management of the operating window for the riser 23 particularly in periods of increased environmental hazard such as high currents. Also, such real-time detection of vortex induced vibration can allow disconnecting the riser 23 in order to prevent catastrophic riser failure and monitoring the riser 23 while disconnected.

For example, in an embodiment of the present invention, the software 135 can include a vortex induced vibration analyzer 161 which, responsive to linear and angular acceleration data provided by at least one but preferably both the subsea riser measurement instrument module 71 and the surface riser measurement instrument module 91, determines an existence of vortex induced vibration. This can be accomplished based on a time domain value series (not shown) derived from the linear and/or angular acceleration data or from a frequency domain value series derived from the time domain value series. The vortex induced vibration analyzer 161 can be subdivided into various functional sections including a riser vibration value time series generator 163 which, responsive to linear and/or angular acceleration data transmitted from either or both of the modules 71, 91, forms the riser vibration value time series or trend.

Where the analysis is to be conducted in the time domain, the vortex induced vibration analyzer 161 can include a riser signature comparator 165 which, responsive to the riser vibration value time series generator 163, compares the riser vibration value time series to signatures 140 stored in a database 139 which represent vibration patterns obtained through test data and experience. Given the riser configuration, along with information such as, for example, the root mean square ("RMS") value for the riser vibration value time series, peak values, and riser statistics such as displacement, bending moment, radius of curvature, and/or others known to those skilled in the art, this comparison can be used to determine a model for vortex induced vibration which can be further used to determine the stress (including change in stress) and fatigue for sections 29 of the riser 23. The stress determiner 159 of software 135, or similar module thereof, can accomplish this task. Further, knowledge of the level of vortex induced vibration not only allows the operator to adjust inspection schedules, operation schedules, and maintenance schedules, but allows for active management of the riser 23 in order to minimize the effect of the vortex induced vibration and to determine if the riser 23 is entering a potentially unsafe condition.

Where the analysis is to be conducted in the frequency domain, the vortex induced vibration analyzer 161 can include a power spectral density determiner 167 which, responsive to the riser vibration value time series generator 163, determines a power spectral density for the riser vibration value time series. Various power levels for either selected frequencies or frequency bands, peak values, or other characteristics known to those skilled in the art, stored in database 139, can be analyzed to determine the existence and level of vortex induced vibration, and thus provide for stress/fatigue determination, maintenance, and active management of the riser 23, as described above.

Referring to FIGS. 4 and 6, due to the emergence of dynamically positionable vessels in deep water, such as, for example, vessel 27, the software 135 can provide for the determination of a secondary position reference based on a different measurement principle, other than the vessel's hydro-acoustic position determining system. This can be useful in satisfying DP Class 3 requirements. For example, the software 135 may include a vessel position determiner 171 which, responsive to the data provided by the surface riser measurement instrument module 91 and preferably the subsea riser measurement instrument module 71 (or a suitable substitute that can provide inclination data), can determine a dynamic position of vessel 27 representing a real-time position of the vessel 27. The vessel position determiner 171 can include an inclination determiner 173 which, responsive to dynamic orientation data for the riser lower portion or lower riser section 73 provided by the subsea riser measurement instrument module 71, can determine a dynamic three-dimensional angle of inclination and heading of the riser lower portion or lower riser section 73, respectively. The inclination determiner 173 can further determine a dynamic three-dimensional angle of inclination and heading from dynamic orientation data for the riser upper portion or upper riser section 93 provided by the surface riser measurement instrument module 91. Note, the inclination determiner 173 can be a single software module or be divided into functionally separate modules 175, 177.

The vessel position determiner 171 can also include a riser tilt and bearing determiner 179 which determines a tilt and a bearing of the riser 23 with respect to True North. The riser tilt and bearing determiner 179 can receive the dynamic angle of inclination and heading for the riser lower portion or lower riser section 73 and riser upper portion or upper riser section 93, determined from the respective dynamic orientation data. The riser tilt and bearing determiner 179 can also access the table of riser models 137.

A vessel offset and bearing determiner 181, responsive to the determined tilt and bearing of the riser 23, can determine a vessel offset distance D and a dynamic position DP of the vessel 27 (FIG. 6), where the vessel offset distance D is defined as a linear distance lying in a plane perpendicular to and extending from the vertical axis V extending from the wellhead 49 (see also FIG. 5). The vessel offset and bearing determiner 181 also determines a bearing B of the riser 23, related to a global reference such as True North, between the vertical axis V and the dynamic position DP of the vessel 27 along an axis collinear with that of the offset distance D, independent of the vessel heading. The offset distance D and bearing B, referenced to a known fixed position, such as that of wellhead 49, define the vessel position DP.

Figure 7:
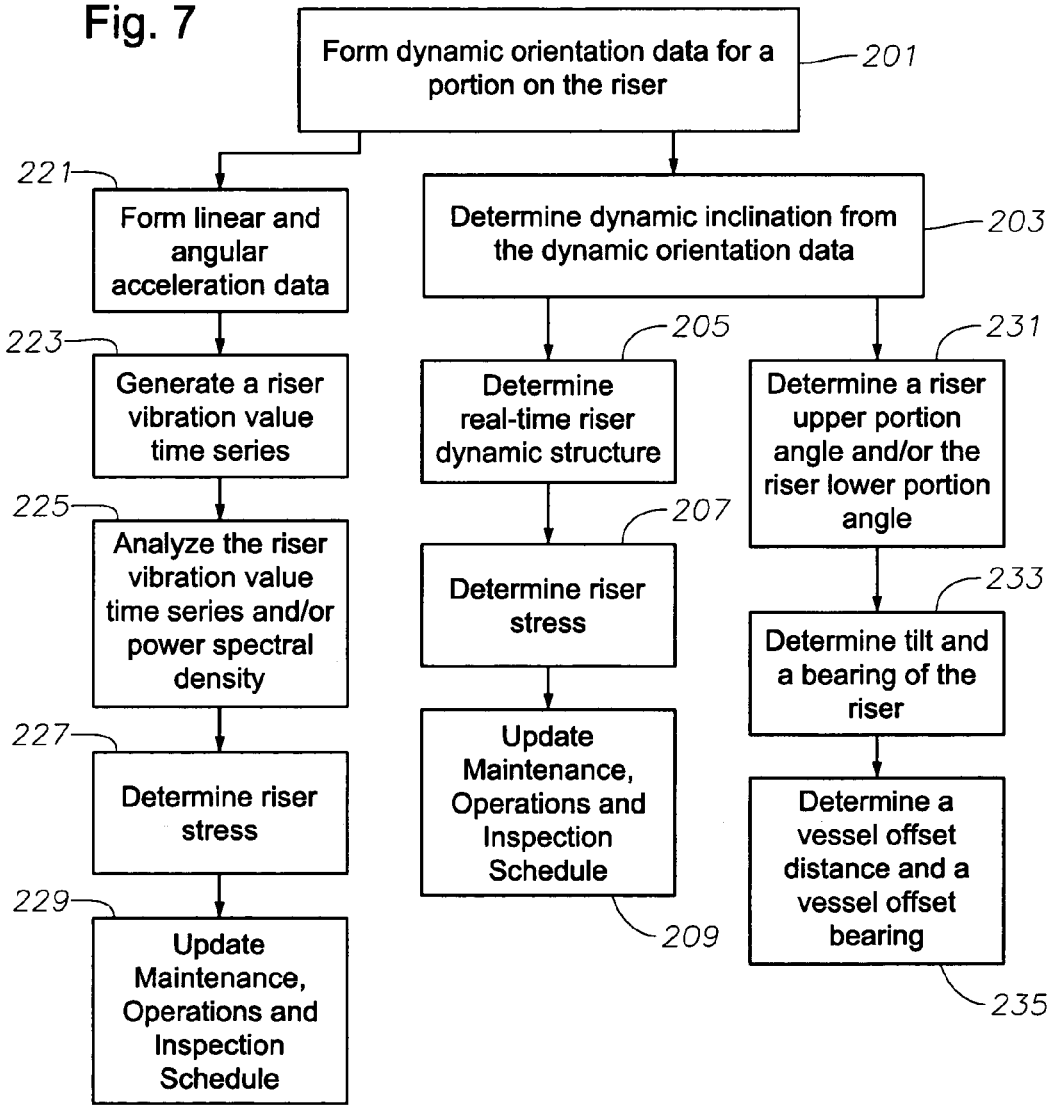
FIG. 7 is a schematic diagram of a flowchart depicting a method for analyzing riser dynamic behavior of a riser system extending between a floating vessel and a subsea wellhead according to an embodiment of the present invention.

Referring to FIG. 7, embodiments of the present invention include methods for analyzing riser dynamic behavior of a riser system extending between a floating vessel and a subsea wellhead to enhance monitoring of the riser system. For example, in an embodiment of the present invention, a method of analyzing the dynamic behavior of riser 23 includes the step of forming dynamic orientation data (block 201) for a portion of the riser 23. Specifically, for the illustrated drilling riser, the dynamic orientation data can be formed for either or both the upper riser section 93 connected to or adjacent the upper flex joint 53 utilizing surface riser measurement instrument module 91 preferably connected adjacent a lower portion of the upper flex joint 53, and the lower riser section 73 connected to the lower flex joint 55 utilizing subsea riser measurement instrument module 71 preferably connected adjacent an upper portion of the lower flex joint 55. A dynamic three-dimensional inclination (angle of inclination) can be determined (block 203) from the riser dynamic orientation data. Specifically, the dynamic inclination can be formed for either or both of: a lower portion of the riser 23, such as, for example, riser section 73, using the lower riser portion dynamic orientation data, and for an upper riser portion of the riser 23, such as, for example, upper riser section 93, using the upper riser portion dynamic orientation data.

The capability of utilizing a three-dimensional inclination is a significant improvement over other prior art methods which only determine riser inclination in a single plane. Further, the position and orientation data, angle of inclination data, and riser lower and upper portion angle data can be captured, real-time, by a database which can log signatures captured by the different modules 25, 71, 91, 111, and data from other more conventional supplementary riser data generating (measurement) systems.

In an embodiment of the present invention, the method can also include determining real-time riser dynamic structure (block 205) utilizing the determined dynamic three-dimensional angle of inclination and a table of predetermined riser structural models 137 preferably stored in the memory 133 of a computer, such as computer 61 (FIG. 2). This can be accomplished by comparing the three-dimensional angle of inclination of preferably at least an upper portion of the riser 23 to the predetermined riser structural models 137. Utilizing the determined riser model along with additional riser statistics such as displacement, bending moment, radius of curvature, and/or others known to those skilled in the art, an operator can determine (block 207) the stress (including change in stress) and loading of sections 29 of the riser 23, which can lead to a determination of fatigue. With this information, the operator can also adjust inspection schedules, operation schedules, and maintenance schedules (block 209). Further the operator can improve asset management by adjusting rotation schedules of the sections 29 whereby sections of riser 23 subjected to above-average stress can be rotated with or replaced by sections 29 subjected to below-average stress.

In an embodiment of the present invention having both a surface riser measurement instrument module 91 connected adjacent the upper riser section 93 and/or a subsea riser measurement instrument module 71 connected adjacent either the lower riser section 73 or a medial portion therebetween, sufficient relative positional information is provided to allow the operator to raise the riser 23 and maintain the vessel 27 such that the upper section 93 of the riser 23 or any buoyancy devices attached thereto do not inadvertently contact the moon pool and damage the buoyancy devices to the extent of needing extensive repairs or replacement.

In an embodiment of the present invention, the method can also include determining an existence of vortex induced vibration by forming linear and/or angular acceleration data (block 221) for the riser 23 utilizing some of the dynamic orientation data from either or both of the subsea riser measurement instrument module 71 and the surface riser measurement instrument module 91. A riser vibration value time series for riser vibration values can be generated (block 223) from linear and angular acceleration data for the riser 23 to form a riser vibration value trend. An analysis (block 225) to determine the existence and optionally a magnitude of vortex induced vibration (FIG. 5) can then be performed either directly on the riser vibration value time series, a time domain based analysis, and/or on a power spectral density for the riser vibration value time series which provides for a frequency domain based analysis. The riser vibration value time series can be compared to a plurality of signatures 140 (FIG. 2) representing vibration patterns stored in a database 139 to determine a model for vortex induced vibration which can be further used to determine the stress (including change in stress) and fatigue for sections 29 of the riser 23 (block 227). With this knowledge, the operator can not only adjust inspection schedules, operation schedules, and maintenance and/or riser section rotation schedules (block 229), but can actively manage the riser 23 in order to minimize the effect of the vortex induced vibration and determine if the riser 23 is entering a potentially unsafe condition.

With the advent of more and more powerful computer systems, synergistically the analysis can be performed in both the time domain and the frequency domain. Thus, the analysis can also include determining a power spectral density for the riser vibration value time series. Various power levels for either selected frequencies or frequency bands, peak values, or other characteristics known to those skilled in the art, can be stored in database 139, and can be analyzed to determine the presence and level of vortex induced vibration, and thus further provide for stress/fatigue determination, maintenance, and active management of the riser 23, as described above.

In an embodiment of the present invention, the method can further include determining a dynamic position DP of a dynamically positionable vessel 27. A riser upper portion angle and/or a riser lower portion angle are determined (block 231), the relationship of which provides the necessary information to determine the vessel position. More specifically, for the illustrated drilling riser, a RLPA, preferably in the form of a LFJA for a lower flex joint 55, and a RUPA, preferably in the form of a UFJA, for the upper flex joint 53, are first determined. The LFJA can be determined from the dynamic three-dimensional inclination for the lower riser section 73 and from inclination data provided by a wellhead measurement instrument module 111 connected adjacent the subsea wellhead 49, preferably to a rigid portion of the LMRP 43. The UFJA can be determined from the dynamic three-dimensional inclination for the upper riser section 93 and from inclination data provided by a vessel measurement instrument module 65 connected to a portion of the vessel 27. A tilt and a bearing of the riser (block 233), preferably with respect to True North can then be determined utilizing: the dynamic three-dimensional angle of inclination and globally oriented heading of the lower riser section 73; and the dynamic three-dimensional angle of inclination and globally oriented heading of the upper riser section 93. From the tilt and the bearing of the riser, the manager determines (block 235) a vessel offset distance D between a vertical axis V extending from the wellhead 49 (see also FIG. 5) and a vessel offset bearing B from the vertical axis V extending from the wellhead 49 and the dynamic position DP of the vessel. The vessel offset distance D and bearing B define the dynamic position DP of the vessel 27.

In another embodiment of the present invention, a method of analyzing riser dynamic behavior of a riser system extending between a floating vessel and a subsea wellhead is performed by separately determining an existence of vortex induced vibration, when so existing. The method includes the steps of forming linear and angular acceleration data, such as that identified in (block 221), for the riser 23 utilizing either or both of the subsea and surface riser measurement instrument modules 71, 91. A time domain value series such as that identified in (block 223) can be generated for riser vibration values from the linear and angular acceleration data for the riser 23. Either a riser vibration value time series or a power spectral density for the riser vibration value time series, identified in (block 225) can be analyzed. The riser vibration value time series can be compared to a plurality of signatures 140 (FIG. 2) representing vibration patterns stored in a database 139 to determine a model for vortex induced vibration which can be further used to determine (block 227) the stress and fatigue for sections 29 of the riser 23. The operator then adjusts (block 229) inspection schedules, operation schedules, and maintenance and riser section rotation schedules, as necessary.

In an embodiment of the present invention, a method of analyzing riser dynamic behavior of a riser system extending between a dynamically positionable floating vessel and a subsea wellhead is performed by separately determining a dynamic position of the floating vessel. The method includes the steps of forming dynamic orientation data (block 201) for riser lower and upper portions, such as the lower and upper riser sections 73, 93, (FIG. 1). From the dynamic orientation data, dynamic three-dimensional inclination and heading, preferably with respect to True North, can be determined (block 203) for such riser lower and upper portions. From such dynamic three-dimensional angle of inclination of the riser lower and upper portions, a tilt and a bearing of the riser 23, identified in (block 233), and a vessel offset distance D, identified in (block 235), between a vertical axis V extending from the wellhead 49 and a dynamic position DP of the vessel 27 can further be determined. The method can also includes determining, from the heading of the riser lower and/or upper portions identified in (block 231) or lower and/or upper riser sections 73, 93, a vessel offset bearing B, preferably with respect to True North, between the vertical axis V and the dynamic position DP of the vessel 27.

The invention has several unique advantages. For example, embodiments of the present invention provide data used to determine the dynamic angle of the upper and lower portions of the riser which can be used with a riser model to determine riser dynamic positioning, which can be used to monitor for vortex induced vibration, and which can be used as a secondary means of determining dynamic positioning of the vessel. The online sensor package measurement instrument modules can be synergistically utilized in conjunction with other riser data generating systems, e.g. corrosion and stress detectors, or information systems such as logged systems, e.g. wireline, acoustic, or fiber-optic, which can add to the knowledge base of riser performance, and which can be used in an advisory model (software). This can be managed through a database which logs signatures captured by the online sensor package of the different modes identified by the online sensor package and the supplementary riser data generating (measurement) systems. The online sensor package can further provide data used to ultimately determine riser response and performance including cumulative fatigue, long-term vortex shedding induced vibration analysis, and verification of component performance. This provides a better model that can be used in fatigue analysis of each of the component parts. Further, knowledge of not only the inclination with respect to the vertical of the riser joints or flex joints but the actual vector in space of the top and bottom portions or individual sections of the riser allows for enhanced application of a model of the typically "spiral" shape of the riser.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification. For example, for riser model determination and to determine vortex induced vibration, the riser monitoring instrumentation modules can be positioned on riser sections other than the upper and lower most sections. Further, the riser monitoring instrumentation modules can be used with vessels that are not necessarily dynamically positionable. Further, although the illustrated embodiment was of the drilling riser, embodiments of the present invention apply to production risers including, but not limited to, steel catenary risers.

The invention claimed is:

1. In an offshore drilling and/or production system having a riser extending between subsea well equipment and a floating vessel, a riser monitoring assembly comprising:

a lower riser measurement instrument module connected to a lower portion of the riser to provide real-time dynamic orientation data for the lower portion of the riser;

an upper riser measurement instrument module connected to an upper portion of the riser to provide real-time dynamic orientation data for the upper portion of the riser;

a computer carried by the vessel and having a memory containing a table of models of the structure of the riser under various orientations along its length and riser system analyzing software stored in the memory, the riser system analyzing software responsive to the dynamic orientation data from the riser measurement instrument modules and the models in the memory to analyze and determine the dynamic structure of the entire riser;

a first data communication line connected between the lower riser measurement instrument module and the vessel to provide communications between the lower riser measurement instrument module and the vessel; and a second data communication line connected between the upper riser measurement instrument module and the vessel separate from the first data communication line to provide communications between the upper riser measurement instrument module and the vessel.

2. The system according to claim 1, wherein the lower portion of the riser includes a lower marine riser package (LMRP), the system further comprising:

a tapless umbilical cord connected between the LMRP and the vessel for supplying power to and communicating the vessel with the LMRP, the first data communication line housed within the LMRP umbilical cord;

an umbilical cord spool positioned on the vessel for storing and deploying the umbilical cord and the second data communication line is exterior of the LMRP umbilical cord.

3. The system according to claim 1, wherein the lower and upper riser measurement instrument modules provide orientation data referenced to True North.

4. The system according to claim 1, wherein each of the riser management instrument modules comprises a self-contained inertial navigation system including a linear accelerometer, a fiber-optic gyro, and a digital signal processor that produces the dynamic orientation data from data provided by the linear accelerometer and the fiber-optic gyro; and wherein the dynamic orientation data received from each of the riser management instrument modules includes angular acceleration, angular velocity, angular displacement, liner acceleration, linear velocity, linear displacement, and heading of the lower riser section.

5. The system according to claim 1, wherein the assembly further comprises:

a vessel measurement instrument module, connected to the vessel, to provide vessel pitch and roll defining a vessel angle of inclination, and to provide vessel heading referenced to a global coordinate system.

6. The system according to claim 1, wherein the software comprises:

a riser angle determiner, responsive to the dynamic angles of inclination data determined from the dynamic orientation data for the lower and upper riser portions, to determine riser portion angles; and a riser model selecter, responsive to the determined riser portion angles and the table of models, to select a model best representing the real-time dynamic structure of the riser.

7. The system according to claim 1, wherein the riser management instrument modules provide at least one of the following: linear acceleration data or angular acceleration data defining riser measurement instrument module data, wherein the assembly includes a database of riser vibration signatures stored in the memory of the computer, and wherein the riser system analyzing software includes:

a vortex induced vibration analyzer, responsive to the riser measurement instrument module data, and the database of riser vibration signatures, to determine an existence of vortex induced vibration from at least one of the following: a time domain value series or a frequency domain value series.

8. The system according to claim 1, wherein the upper riser measurement instrument module provides a dynamic angle of inclination and heading of the upper portion of the riser;

the lower portion riser measurement instrument module provides a dynamic angle of inclination and heading of the lower portion of the riser; and wherein the riser system analyzing software further includes a vessel position determiner, responsive to the dynamic angle of inclination and heading of the lower portion of the riser and the dynamic angle of inclination and heading of the upper riser portion of the riser, to determine a bearing of the riser, to thereby determine a position of the vessel.

9. An offshore drilling and/or production system, comprising:

a dynamically positionable vessel having a vessel riser management system interface;

a lower marine riser package (LMRP) for connection to a subsea wellhead and having an umbilical cord termination junction box and a LMRP riser management system interface electrically and optically connected to the umbilical cord junction box;

an umbilical cord connected between the umbilical cord termination box and the vessel to provide power and communication between the LMRP and the vessel, the umbilical cord stored and deployed by an umbilical cord spool positioned on the vessel;

a riser having an upper section connected to the vessel and a lower section connected to the LMRP;

the riser having a lower flex joint connected to an upper portion of the LMRP, the lower flex joint having a lower flex joint angle (LFJA);

the riser having an upper flex joint to flexibly connect the vessel to the upper section of the riser, the upper flex joint having an upper flex joint angle (UFJA);

a subsea riser measurement instrument module electrically connected to the LMRP riser management system interface and connected to the lower flex joint to provide real-time dynamic orientation data for the lower section of the riser;

a first communication line housed in the umbilical and extending between the subsea riser measurement instrument module and the vessel;

a surface riser measurement instrument module electrically connected to the vessel riser management system interface and connected to the upper flex joint to provide dynamic orientation data for the upper section of the riser;

a second communication line extending from the surface riser measurement instrument module exterior of the umbilical; and a computer carried by the vessel and having a memory containing a table of structural models of the riser and riser management system analyzing software stored in the memory, the riser system analyzing software comparing the orientation data from the subsea and the surface riser measurement instrument modules to determine a riser model representing a real-time dynamic structure of the entire riser.

10. The system according to claim 9, wherein the subsea riser measurement instrument module provides orientation data referenced to a globally assigned coordinate system.

11. The system according to claim 9, wherein the subsea and the surface riser management instrument modules each comprise a self-contained inertial navigation system including a plurality of linear accelerometers, a plurality of fiber-optic gyros, and a digital signal processor that produces the dynamic orientation data from acceleration data provided by the plurality of linear accelerometers and the plurality of fiber-optic gyros; and wherein the three-dimensional dynamic orientation data provided by the subsea and the surface riser management instrument modules include angular acceleration, angular velocity, angular displacement, liner acceleration, linear velocity, linear displacement, and heading of the respective lower and the upper riser sections.

12. The system according to claim 9, further comprising:

a wellhead measurement instrument module connected to a rigid portion of the LMRP to provide wellhead angle of inclination from vertical, a difference between the wellhead angle of inclination and a three-dimensional angle of inclination of the lower riser section determined from the dynamic orientation data for the lower riser section defining the LFJA; and a vessel measurement instrument module connected to a rigid portion of the vessel to provide vessel pitch and roll defining a vessel angle of inclination and vessel heading referenced to a global coordinate system, a difference between the vessel angle of inclination and a three-dimensional angle of inclination of the upper riser section determined from the dynamic orientation data for the upper riser section defining the UFJA.

13. The system according to claim 9, wherein the software includes:

a riser lower flexible joint angle determiner, responsive to inclination data from the wellhead measurement instrument module and dynamic three dimensional inclination data determined from the dynamic orientation data for the lower riser section, to determine the LFJA;

a riser upper flexible joint angle determiner, responsive to inclination data from the vessel measurement instrument module and dynamic inclination data determined from the dynamic orientation data for the upper riser section, to determine the UFJA; and a riser model selector, responsive to the determined LFJA and the UFJA and the table of models stored in the memory of the computer, to select a model representing the real-time dynamic structure of the entire riser.

14. The system according to claim 9, wherein the system further includes a database of riser vibration signatures stored in the memory of the computer, and wherein the riser system analyzing software includes a vortex induced vibration analyzer, responsive to the database of riser vibration signatures and at least one of linear acceleration data and angular acceleration data provided by at least one of the subsea and the surface riser measurement instrument modules, to determine an existence of vortex induced vibration.

15. The system according to claim 9, wherein the riser system analyzing software includes:

a vessel position determiner, responsive to a dynamic three-dimensional angle of inclination and heading of the lower riser section determined from the dynamic orientation data for the lower riser section and a dynamic three-dimensional angle of inclination and heading of the upper riser section determined from the dynamic orientation data for the upper riser section, to determine a bearing and distance of the vessel from the wellhead.

16. A method for analyzing riser dynamic behavior of a riser system extending between a floating vessel and a subsea wellhead system to enhance monitoring of the riser system, the method comprising the steps of:

providing the riser with a riser measurement instrument module on a lower portion of the riser and on an upper portion of the riser, each of the modules having an inertial navigation system;

forming dynamic orientation data for the lower and upper portions of the riser utilizing the riser measurement instrument modules;

determining a dynamic three-dimensional angle of inclination with global geographic coordinates for the lower and upper portions of the riser from the dynamic orientation data;

providing a database with a table of models of the riser undergoing various angles of inclination along its length;

comparing the angles of inclination of the lower and upper portions to the models and determining dynamic three-dimensional angles of inclination with global geographic coordinates for the portion of the riser between the lower and the upper portions.

17. The method according to claim 16, further comprising determining an existence of vortex induced vibration, when so existing, including the steps of:

forming linear and angular acceleration data for the riser utilizing the riser measurement instrument modules;

generating a riser vibration value time series for the riser from at least one of the linear and angular acceleration data; and analyzing the riser vibration value time series by comparing the riser vibration value time series to a database of riser vibration signatures.

18. The method according to claim 16, further comprising determining a dynamic position of the vessel, including the steps of:

determining a heading for the lower portion of the riser from the riser lower portion dynamic orientation data;

determining a heading for the upper portion of the riser from the riser upper riser portion dynamic orientation data;

determining a tilt and a bearing of the riser utilizing the dynamic three-dimensional angle of inclination and heading with respect to the lower riser section and the dynamic three-dimensional angle of inclination and heading with respect to the upper riser section; and determining, from the tilt and the bearing of the riser, a vessel offset distance between a vertical axis extending from the wellhead and a dynamic position of the vessel and a vessel offset bearing between the vertical axis extending from the wellhead and the dynamic position of the vessel.

19. A method for analyzing riser dynamic behavior of a riser system extending between a floating vessel and a subsea wellhead system to enhance monitoring of the riser system, the method comprising the steps of:

providing a computer having memory and a table of predetermined structural models stored in the memory, the structural models simulating various shapes that the riser might take along its length under various environmental conditions;

providing the riser with an upper riser measurement instrument module on an upper portion of the riser and a lower riser measurement instrument module on a lower portion of the riser;

forming dynamic orientation data for the upper portion of the riser utilizing the upper riser measurement instrument module;

forming dynamic orientation data for the lower portion of the riser utilizing the lower riser measurement instrument module;

determining an angle of inclination for the upper portion of the riser from the upper riser portion dynamic orientation data; and determining an angle of inclination for the lower portion of the riser from the lower riser portion dynamic orientation data; and determining a real-time riser dynamic structure representing a real-time structure of the entire riser utilizing the determined angles of inclination for the upper and lower portions of the riser and the table of predetermined riser structural models without utilizing any riser measurement instrument modules between the lower and the upper riser measurement instrument modules.

20. The method according to claim 19, wherein the riser comprises a plurality of riser sections each having a stress level, the method further comprising the steps of:

responsive to the determined real-time riser dynamic structure, determining the stress level for each of the plurality of riser sections; and rotating a riser section having a higher than average stress level with a riser section having a lower than average stress level.

21. A method for analyzing riser dynamic behavior of a riser system extending between a floating vessel and a subsea wellhead system to enhance monitoring of the riser system, comprising the steps of:

providing the riser with at least one of the following: a subsea riser measurement instrument module positioned on a lower portion of the riser or a surface riser measurement instrument module positioned on an upper portion of the riser defining riser measurement instrument model data;

providing on the vessel a computer having memory and a table of predetermined models of the configuration of the riser under various wind and current conditions stored in the memory;

forming dynamic orientation data for the lower portion of the riser utilizing the subsea riser measurement instrument module;

forming dynamic orientation data for the upper portion of the riser utilizing the surface riser measurement instrument module;

determining with the computer a real-time riser dynamic structure representing the entire riser by utilizing the dynamic orientation data from the modules and the table of predetermined riser structural models;

forming linear and angular acceleration data for the riser utilizing the riser measurement instrument module data; and analyzing the linear and angular acceleration data for the riser to thereby determine an existence and magnitude of vortex induced vibration.

22. A method for analyzing riser dynamic behavior of a riser system, extending between a subsea wellhead system and a floating vessel carrying a computer having memory, to enhance monitoring of the riser system, the method comprising the steps of:

providing the riser with a subsea riser measurement instrument module on a lower portion of the riser and a surface riser measurement instrument module on an upper portion of the riser;

providing on the vessel a computer having memory and a table of predetermined riser structural models stored in the memory;

forming dynamic orientation data for the lower portion of the riser utilizing the subsea riser measurement instrument module;

forming dynamic orientation data for the upper portion of the riser utilizing the surface riser measurement instrument module;

determining with the computer a real-time riser dynamic structure representing a real-time structure of the entire riser utilizing the dynamic orientation data from the modules and the table of predetermined riser structural models;

providing a database of riser vibration signatures stored in the memory of the computer;

forming acceleration data for the upper and lower portions of the riser utilizing the riser measurement instrument modules;

generating a riser vibration value time series for the riser from the acceleration data for the riser; and analyzing the riser vibration value time series by comparing the riser vibration value time series to the database of riser vibration signatures.

23. The method according to claim 22, wherein the riser comprises a plurality of riser sections, each having a stress level, the method further comprising the steps of:

responsive to the riser vibration value time series analysis, determining the stress level for each of the plurality of riser sections; and rotating a riser section having a higher than average stress level with a riser section having a lower than average stress level.

24. A method for analyzing riser dynamic behavior of a riser system extending between a floating vessel and a subsea wellhead system to enhance monitoring of the riser system, the method comprising the steps of:

providing the riser with a subsea riser measurement instrument module on a lower portion of the riser and a surface riser measurement instrument module on an upper portion of the riser;

providing on the vessel a computer having memory and a table of predetermined riser structural models stored in the memory;

forming dynamic orientation data for the lower portion of the riser utilizing the subsea riser measurement instrument module;

determining a dynamic angle of inclination for the lower portion of the riser from the lower riser portion dynamic orientation data;

forming dynamic orientation data for the upper portion of the riser utilizing the surface riser measurement instrument module;

determining a dynamic angle of inclination for the upper portion of the riser from the upper riser portion dynamic orientation data; and determining with the computer a real-time riser dynamic structure representing a real-time structure of the entire riser utilizing the determined angles of inclination for the upper and lower portions of the riser and the table of predetermined riser structural models.

* * * * *